US010780008B2

(12) United States Patent
Tavares

(10) Patent No.: US 10,780,008 B2
(45) Date of Patent: Sep. 22, 2020

(54) OSCILLATING HOSPITAL BED AIMED AT PREVENTING DECUBITUS ULCER

(71) Applicant: Kleber Elias Tavares, Belo Horizonte (BR)

(72) Inventor: Kleber Elias Tavares, Belo Horizonte (BR)

( * ) Notice: Subject to any disclaimer, the term of this patent is extended or adjusted under 35 U.S.C. 154(b) by 0 days.

(21) Appl. No.: 15/746,413

(22) PCT Filed: May 24, 2017

(86) PCT No.: PCT/BR2017/050131

§ 371 (c)(1),
(2) Date: Jan. 21, 2018

(87) PCT Pub. No.: WO2018/137011

PCT Pub. Date: Aug. 2, 2018

(65) Prior Publication Data

US 2019/0336369 A1 Nov. 7, 2019

(30) Foreign Application Priority Data

Jan. 26, 2017 (BR) ..... 10 20170016706

(51) Int. Cl.
*A61H 1/00* (2006.01)
*A61G 7/005* (2006.01)
(Continued)

(52) U.S. Cl.
CPC ..... *A61H 1/003* (2013.01); *A61G 7/005* (2013.01); *A61G 7/018* (2013.01); *A61G 7/0573* (2013.01); *A61H 1/001* (2013.01); *A61H 1/005* (2013.01); *A61G 2203/20* (2013.01); *A61G 2203/42* (2013.01); *A61H 2201/0138* (2013.01);
(Continued)

(58) Field of Classification Search
CPC ..... A61H 1/00; A61H 1/001; A61H 1/003; A61H 1/005; A61H 23/00; A61H 2201/0138; A61H 2201/0142; A61H 2201/0146; A61H 2201/0149; A61H 2203/0443; A61H 2203/0456; A61G 7/00; A61G 7/001; A61G 7/002; A61G 7/005; A61G 7/008; A61G 7/012; A61G 7/018; A61G 7/057; A61G 7/05707; A61G 7/05723; A61G 7/0573; A61G 7/072; A61G 7/10; A61G 7/1019; A61G 2203/42; A61G 2203/20
See application file for complete search history.

(56) References Cited

U.S. PATENT DOCUMENTS 4,498,704 A * 2/1985 Hildreth ..... A47C 7/383 297/397
4,958,627 A * 9/1990 Park ..... A61H 23/0263 601/108
(Continued)

*Primary Examiner* — Colin W Stuart
(74) *Attorney, Agent, or Firm* — Scott Houtteman; Houtteman Law, LLC

(57) ABSTRACT

Oscillating hospital bed that smoothly changes the body support points to vary the effective area of body support on the bed with slow, constant oscillations, in the directions of the width and length of a mattress support, characterized by having sets of drive systems attached to a chassis which supports other components, such as an electric motor, a control panel, a thread vertical shaft, a rotation shaft and noise and vibration absorbing cushions.

1 Claim, 4 Drawing Sheets

(51) Int. Cl.
*A61G 7/018* (2006.01)
*A61G 7/057* (2006.01)

(52) U.S. Cl.
CPC ..... *A61H 2201/0142* (2013.01); *A61H 2201/0146* (2013.01); *A61H 2203/0443* (2013.01)

(56) References Cited

U.S. PATENT DOCUMENTS 7,305,727 B2 * 12/2007 Horlin ..... A47C 21/006 5/607
2003/0088919 A1 * 5/2003 Lin ..... A61G 13/009 5/620
2004/0230145 A1 * 11/2004 Kim ..... A61H 1/00 601/99
2005/0033203 A1 * 2/2005 Son ..... A61H 1/005 601/98
2006/0117482 A1 * 6/2006 Branson ..... A61G 7/001 5/600
2007/0067072 A1 * 3/2007 Chopcinski ..... A61G 5/04 701/1
2008/0058167 A1 * 3/2008 Schippers ..... A61H 1/006 482/51
2008/0235872 A1 * 10/2008 Newkirk ..... A61G 7/018 5/600
2011/0245732 A1 * 10/2011 Mravyan ..... A61B 5/1116 600/587
2013/0340168 A1 * 12/2013 Meyer ..... A61G 7/015 5/615
2014/0310876 A1 * 10/2014 Roussy ..... A61G 7/015 5/613
2014/0330464 A1 * 11/2014 Lautzenhiser ..... A61G 5/04 701/22
2015/0164721 A1 * 6/2015 Miyashita ..... A61G 7/0573 5/617
2015/0335505 A1 * 11/2015 Hashimoto ..... A47C 20/04 5/617
2018/0064594 A1 * 3/2018 Finch, Jr. ..... A61G 7/008

* cited by examiner

OSCILLATING HOSPITAL BED AIMED AT PREVENTING DECUBITUS ULCER

APPLICATIONS OF THE PRESENT PATENT

Process for mitigating the risk for developing pressure ulcers

Equipment intended to minimize the risk for developing pressure ulcers and also to be used as a coadjutant treatment Prevention of skin infection in hospitalized patients and when home-care patient's mobility is impaired by equipment and/or paralysis and in similar situations.

Prevention of comorbidities in patients who lie in bed motionless.

Prevention of pressure ulcers in the case of people with special needs due to obesity or acute thinness, wheelchair users and/or people with other types of mobility impairments, while lying in the bed of the present patent whether at a hospital, home or hotel.

STATE OF THE ART

People with mobility impairments lying in a hospital bed or at home for a period greater than five days, which is considered a "long stay", may develop a variety of skin lesions and pressure ulcers due to their weight being continually supported by few points of the body, which oftentimes are not provided with protecting fat or muscle pads, in which case a protruding bone becomes prevalent under the skin, thereby reducing the blood flow in these specific areas, which may eventually lead to skin lesions that threatens the survival of the skin in that area.

In addition to causing pain to patients, pressure ulcers require exhaustive nursing care and, regardless of the quality of such services, these ulcers may get worse, thus becoming the source of infection through the rupture of the skin, and may progressively, sometimes very rapidly, evolve to larger pressure ulcers that may lead to generalized infection (sepsis) and to a large extent even to death.

Since all damage from the healing process runs contrary to the overriding principle of medicine—"Primum non nocere"—the prevention and treatment of pressure ulcers that have already erupted must receive all medical and nursing attention to be eliminated by existing methods and/or instruments and/or medication.

The usual anatomical points of the human body on which the weight of the body rests on the mattress can cause excessive pressure on the dermis. This situation leads to local ischemia and its harmful consequences when the time during which the location remains in ischemia exceeds the dermis' ability to survive.

The position of one of the decubitus over an extended period of time, by itself, decreases local blood flow.

Some of the other factors responsible for the formation of ulcers are: the humidity of the location caused by normal or excessive sweating or due to high temperature, aggravated by high relative humidity in the air, the patient's age, the number of other anatomical and integument elements between the bone and the dermis, the presence of shearing forces due to parallel stresses between the skin and garments or mattress, and the frequent occurrence whereby the patient is unable to voluntarily change body position and avoid being in one position as in the case of spinal cord injury and other episodes of loss of consciousness such as in a coma or other types of severe immobility.

A reduction in pressure ulcer formation has been observed in the use of a pneumatic mattress, which increases the support area and reduces local pressure, but in many cases has failed to prevent the appearance of pressure ulcers, even with technically adequate use.

The simplest and most universally employed solution is to change the patient's position every two hours with the aid of nursing services because the patient's weight and presence of various pieces of equipment often restricts mobility and makes it difficult to shift position every two hours. In addition, unfortunately, dependence on the human factor, in some cases, does not meet the prescribed need and, thus, allows pressure ulcers to erupt.

Comments on the State of the Art

Changing a patient's position at two-hour intervals, which is the most frequently used, along with requiring intense, uninterrupted effort, is subject to failure, both in the hospital and the patient's home. Moreover, sleep interruptions when handling the patient every two hours implies loss of sleep and quality of rest, which are vitally important to the patient's clinical recovery.

Improvements to the State of the Art

The purpose of this present invention is to advance the state of the art by mitigating the risks of pressure ulcer formation by means of a smooth, steady change in the body's support points to vary the body's effective support area on the bed, thereby reducing as close to zero as possible the amount of time pressure is exerted by the body on the bed and restricted support areas, with simultaneous increase in blood flow to all parts of the body exposed to ischemia.

The devices that carry out the movements were developed so as to apply slow, steady oscillations in the directions of the length and width of the mattress, which are preferably concurrent and may be applied singly in only one direction at a time.

Mattress support, which causes it to effect the above-mentioned oscillations, rests on a chassis that produces the longitudinal oscillations by being raised and lowered by one of its ends, with transversal oscillations applied to the mattress support being made in relation to the chassis, the mattress support being flat or built as an arc of circumference.

The steady tilting of the patient's body also produces beneficial variations in blood flow to the places where the body rests, which is a basic factor for the health and resistance of the dermis.

The present invention, beds for hospital use, is also intended for domestic and hotel use; as such, very thin people and paraplegics, with protruding pelvic or sacral bones, and people with a tendency to form pressure ulcers, may use this invention as a bed for sleeping, given that human beings spend about one-third of their lives in bed, and even healthy people can enjoy this equipment to prolong and improve the quality of their sleep, an important factor in one's quality of life, since not remaining in specific positions removes the discomfort caused by the normal kind of pressure that often wakes people up to change position.

Oscillations applied by this present invention, in either direction, have amplitudes just strong enough to steadily move and vary the support points of the user's body to other areas and are made so quietly and slowly they are imperceptible to most users and do not disturb or wake them up, allowing the user to sleep without interruption and dispensing with the need for nursing staff to wake the patient up every two hours to change position, in the case of hospital or homecare applications.

For users of equipment with a greater sensitivity to movement, it proposes that the oscillation occurs in minimum amplitudes for a prolonged period of time, but enough so the patient does not remain in the same position, thus risking ischemia of the skin and, in those cases that require greater amplitude in the oscillations such as obesity or a fixed wound, there is a feature shown in FIG. 5A consisting of a removable pillow support, which is set at an adjustable height to the bed's chassis and supports the head in a stable, horizontal position while only the body is subjected to the oscillations.

Users' adaptation to the beds of this present invention will be quantified in terms of time and comfortable, efficient degrees of tilting so as to achieve the intended objective.

Creativity scholars came up with the word "serendipity", which refers to Shakespeare's tale, "The Three Princes of Seredip", who traveled the world in search of certain goals, but always found different, better things in the end; it is, in fact, a fable about creativity, discovery.

In the case of this invention, serendipity occurred through the author's perception during his own personal experiences in that the bed provided him with a better quality of sleep and, therefore, life, for the following reasons:

1—In its search for sleep, the body seeks the most comfortable position; however, inevitably, staying in one position for a long period of time causes localized pressure in the bony protrusions.

2—are people who abruptly shift position while sleeping; these sudden changes lead to strong shearing forces between the skin and body support, generally the bed sheet. In warm weather or with high relative humidity and sweating, this shearing is more damaging to the points that usually come into contact with the body support.

The bed of this present invention, when used as a bed for sleeping by people with these indications, through minimal, almost imperceptible changes, decreases the number of shifts in body position while asleep and, therefore, boost the quality of sleep, with all its beneficial consequences to health.

For the sake of simplicity, the illustrations in this patent report will be prepared showing only the arched mattress support, since everything that applies to it also applies to the mattress' flat or curved support.

Each complete oscillation applied to the mattress support in the transverse direction is described starting with the mattress' arched support being in the center or rest position, in which their longitudinal edges are flush; oscillation begins with one of the longitudinal edges of the mattress' arched support being raised; this movement proceeds to the maximum set amplitude when it is then interrupted and inverted and the edge is lowered to the minimum lowering level, where identical motion starts.

Each complete oscillation applied to the mattress support in the longitudinal direction is described starting with the mattress support being parallel to the floor; oscillation begins when the longitudinal end where the user's head is accommodated is preferably raised and movement proceeds to the maximum set amplitude when it is then interrupted and inverted and said longitudinal end is lowered back to the original level whereby it is parallel to the floor, where identical motion starts; thus, oscillations in the longitudinal direction do not place the user's head at a level lower than his or her feet.

The control panel with programmable microprocessor allows transversal and longitudinal movements to be applied in isolation or, preferably, combined.

The embodiments of the present invention can meet any patient's biotype, from children up to tall and obese adults, and may have any measurement or weight capacity as needed.

Each complete oscillation in either direction may preferably have amplitudes up to 20 cm, depending on the width and length of each set, and each part of the oscillation cycle may preferably last between 20 and 100 minutes.

However, timing of the movements may be appropriately adjusted to fit the user's needs.

Oscillation amplitudes in both directions, as well as the times for cycle completion, are individually controlled by a single programmable control panel, which can be programmed for any values between the minimum and maximum amplitudes, as well as any amount of time between the equipment's minimum and maximum duration, and also has the ability to quickly return the arched support and chassis to rest levels.

The flat or arched mattress bed should be protected by removable or tilted side rails, as are all hospital beds, to prevent any undesirable movement by the patient and prevent people from sitting on the edge of the patient's bed.

For safety reasons, the beds of this invention are preferably battery-operated and without connection to the electric grid.

The preferred embodiment of this invention, considered more economical, both from the viewpoint of manufacturing cost and electric power operational costs, includes a microprocessed, programmable control panel with residing software that does away with limit and shaft position switches, memory and inclinometer devices and, in this version, used "PWM—Pulse Width Management" technology to control the two motors, which operate by means of intermittent pulses to increase the life of the batteries and make it easy to change them without causing interruptions that may influence the intended therapeutic outcome and without requiring excessive administrative services.

In addition to the preferred embodiment described herein, it will be understood that many other ways of producing the oscillations of this invention fall within the concept of this invention, such as replacing the mechanical air mass displacement components with hydropneumatic devices or any others that provide the same effects under the conditions described herein.

ILLUSTRATIONS

So as to enable proper visualization and a clear understanding of the concepts applied to the preferred embodiment, schematic illustrative figures are attached where:

FIG. 3 is a schematic sectional view of two sets of drive systems that are attached to the chassis;

Below is a detailed description of the figures mentioned above.

Figure 1:
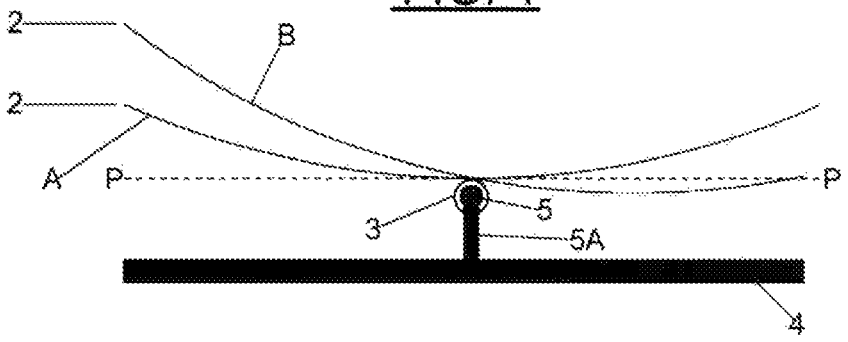
FIG. 1 shows a cross-section of the arched mattress support.
Figure 2:
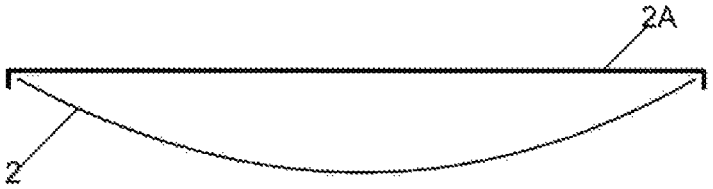
FIG. 2 is a cross-sectional view of the flat mattress support.

FIG. 1 is a schematic cross-section of the arched mattress support (1); to simplify this report, only the arched mattress support is shown (2), and, as shown in FIG. 2, the flat support (2A) is removable and is placed on the arched support (2) by a groove or any other suitable means; FIG. 1 shows the arched mattress support (2) in the center or resting position (A); it also shows the arched mattress support (2) in the maximum elevation position (B) with the elevation applied to one of the longitudinal ends, due to the action of the cylindrical shaft, which connotes the symmetrical contrary change on the opposite side; thus raising one of the longitudinal ends of the arched support (2) by "H" height will produce a difference equal to "2H" between the ends of the arched mattress support (2), which, when in the resting position, were level; also seen is a dashed line representing the plane (P) parallel to the floor and the cylindrical shaft (3), which is attached to the arched support (2) over the entire length of its longitudinal center line with the cylindrical shaft being hinged to the two shafts (5) attached to the supports (5A) placed at the longitudinal ends of the chassis (4) so that the arched support (2) can rotate around its middle or center part and create transversal oscillations.

FIG. 2 is a schematic cross-sectional view of the flat support (2A) and its relationship with the arched support (2) to which it is coupled and whose behavior is the same as that of the support.

Figure 3:
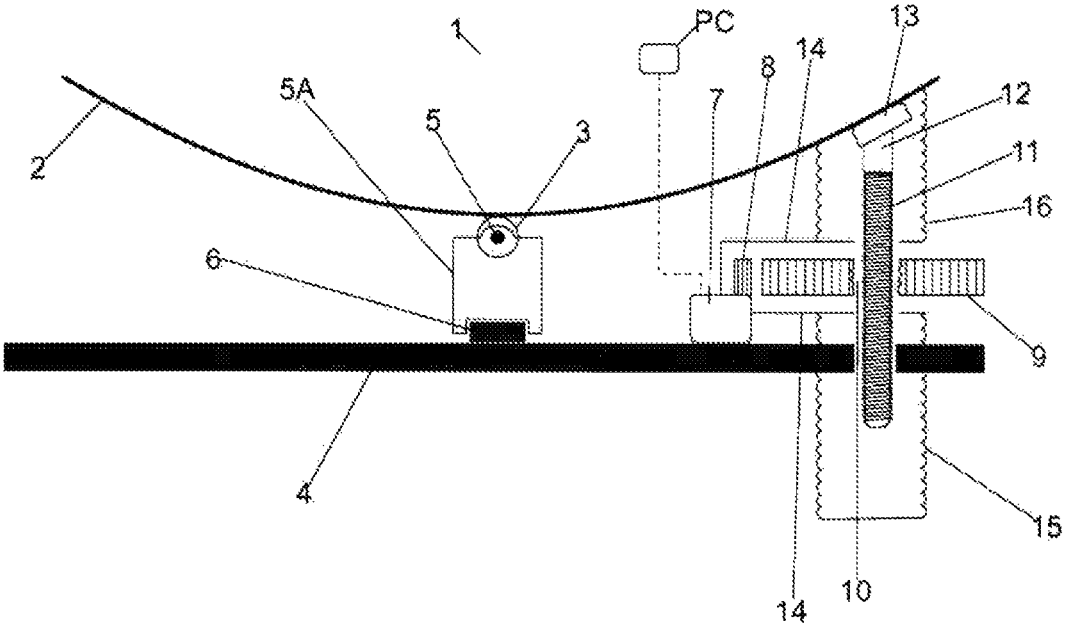
FIG. 3 is a cross-sectional view of the mattress support showing the components that drive the arched support.

FIG. 3 is a schematic, non-dimensional cross-sectional view showing the components that drive the arched support (2) to produce the transversal oscillations made by the mechanical devices such as electric motors, shafts, and conventional gears that together form the drive system (SA), which comprise the preferred version of the equipment of this invention, this form being but one of dozens that may possibly be used to deliver the movements provided by this invention, such as hydropneumatic solutions, it can be seen in FIG. 3 that the motor (7) and other drive components are appropriately attached to the chassis (4), with the chassis (4) being crossed by the vertical pinion (11); also seen is the electric motor (7) driven by a power drive (PWM) in the control panel (PC), which preferably operates at 24V DC, is silent and with a reversible rotation direction; the electric motor's shaft (7) has a gear (8) connected to another gear (9) and a minimum pitch (10), which drives the worm thread vertical shaft (11) intended to move the flat or arched mattress support (2) vertically; also seen is the coupling (13) that carries out the vertical coupling of the tip (12) of the vertical shaft (11), which allows adjustment of the coupling (13) and tip (12) of the vertical shaft (11) to the lateral movements between the tip (12) of the vertical shaft (11) and the flat or arched mattress support (2) resulting from transversal oscillations.

The microprocessed control panel (PC) controls the motor's speed and rotation direction, as well as the rotation time in each direction, which results in controlling the amplitude and frequency of the flat or arched mattress support's oscillations in the transverse direction; also seen is the rotation shaft support (5), which couples with the cylindrical shaft (3) attached to the arched mattress support (2), the equipment's chassis (4), and the noise and vibration absorbing cushion (6), which dampens noise and vibrations from the support (5A); also shown is the support (14) of hoods (15) and (16) that surround and protect the vertical screw shaft (11) from accidental contact and dust.

Figure 4:
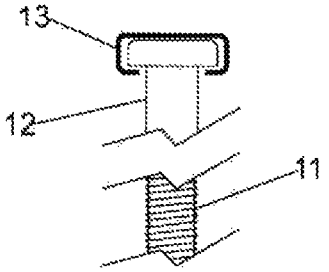
FIG. 4 shows a detailed view of the coupling to the arched support.

FIG. 4 is a detailed view of the coupling (13) attached to the arched support shown in FIG. 2, which makes the mobile coupling between the tip (12) of the vertical shaft (11) and the arched mattress support (2) shown in the previous figures; this feature allows the tip (12) of the vertical shaft (11) to move horizontally within the coupling (13) so the devices of this invention are not subject to the forces and transversal movements resulting from the rotation of the arched mattress support (2), which is attached to the cylindrical shaft (3); it can be seen that the coupling (13) is in the shape of the letter 'C' with an open hole in the lower part into which the tip (12) of the vertical shaft, which is T-shaped, can slide, with the coupling being applied to any point of the arched mattress support (2) closest to one of the edges.

Figure 5:
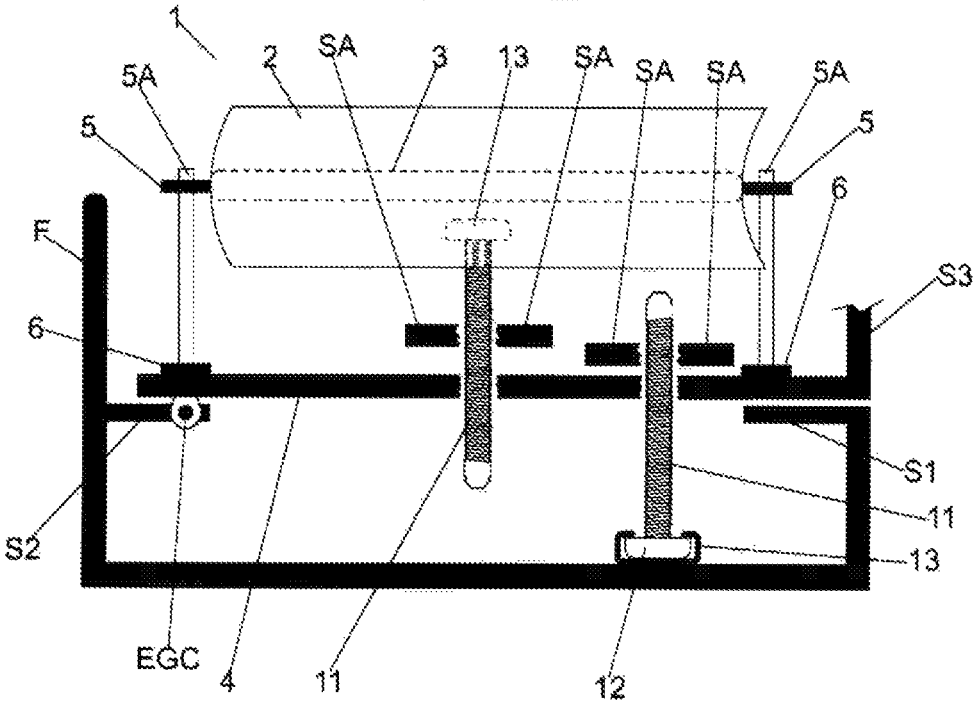

FIG. 5 is a schematic longitudinal cross-sectional view of an example of the equipment of this invention with two sets of drive systems (SA) that are attached to the chassis (4) in a suitable manner and are composed of the mechanical devices that apply the oscillations to the arched support (2), one for transversal oscillations and the other for longitudinal oscillations; the arched support (2) is seen and, by means of transparency, the cylindrical shaft (3) and coupling (13); also seen are the shafts (5) and supports (5A), placed at the longitudinal ends of the arched support (2), the cushions (6), and the two drive systems (AS), coupled to the two vertical shafts (11), which is placed to right of FIG. 5 and is coupled to the coupling (13) by its tip (12) to raise and lower the chassis (4) longitudinally and is supported on the bed frame (F); the minimum raising or lowering position of the chassis (4) is mechanically maintained by the support limiter (S1), which is attached to the bed frame (F); it can also be seen to the left of FIG. 5) that the chassis (4) can rotate around its shaft (EGC), attached to the support (S2), which is also attached to the bed frame (F).

Figure 5A:
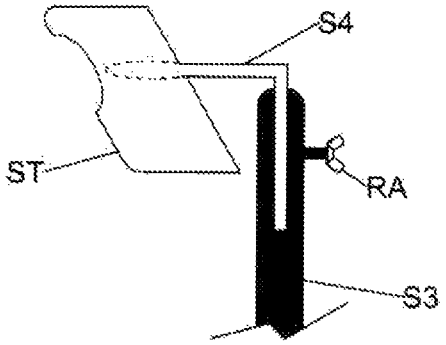

FIG. 5A is a perspective view of the pillow support (ST), which is attached to support (S3) through the support (S4) and height adjuster screw (RA), which is inserted through the cephalic end of the chassis (4) and whose height is adjustable through the height adjuster (RA), whose function is to secure the user's head in a fixed manner without moving in response to changes in body position resulting from transversal oscillations and avoid labyrinthism in people who are sensitive to motion.

Figure 6:
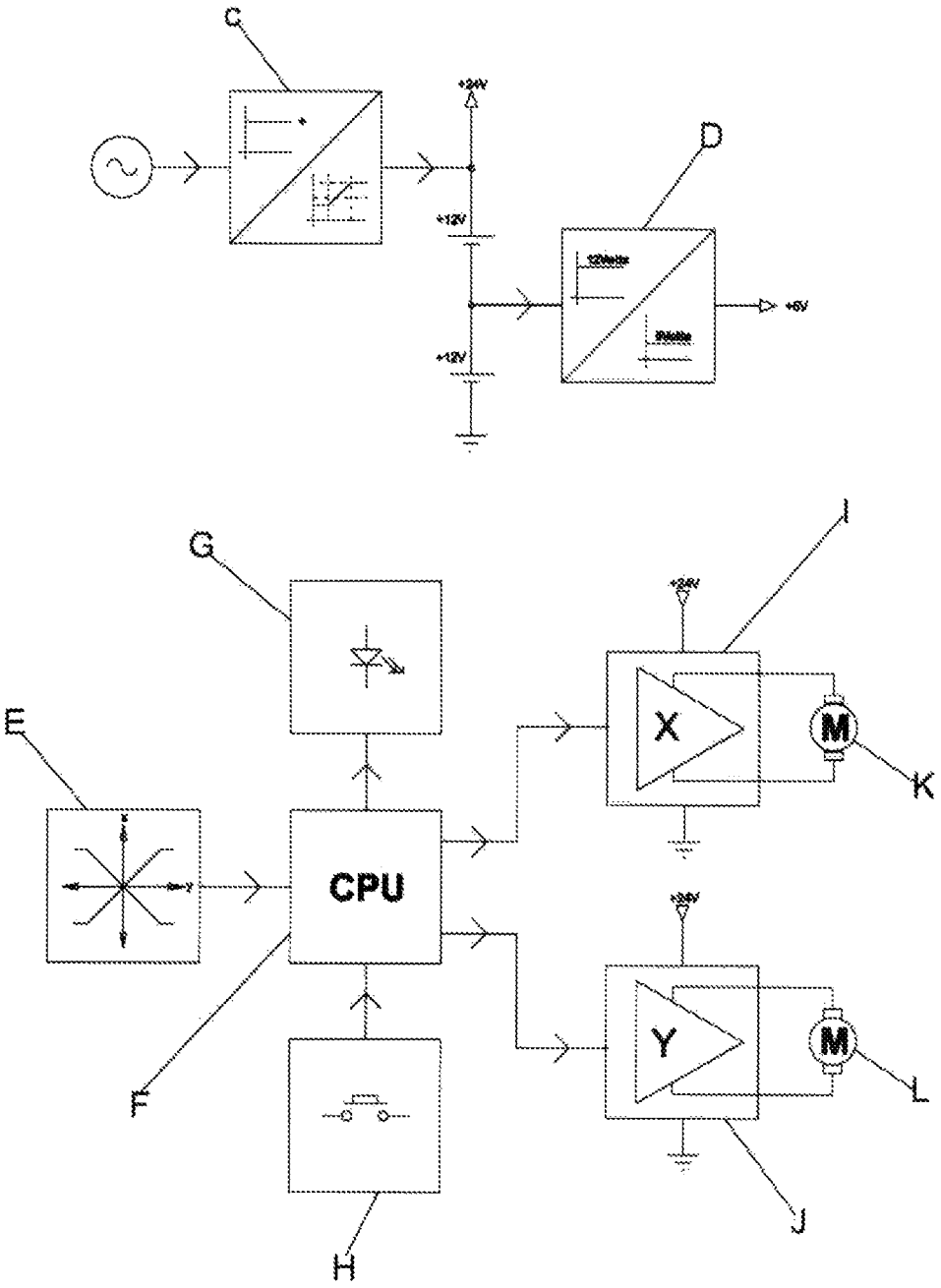
FIG. 6 shows the control panel blocks diagram.

FIG. 6 shows the control panel blocks diagram (PC) that presents the preferred embodiment of its operation; the upper part of FIG. 6 shows the power unit in a way that is separate from the operating unit, which, in this example, is composed of a controlling charge rectifier (C), which charges two 12-V batteries, and a voltage regulator (D), which supplies 24 V to two motors and 5 V to the CPU by means of two parallel batteries.

The blocks in the lower part of FIG. 6 show the tilt sensor (E), which has two measuring axes—one for the longitudinal tilt (Y) and another for the transverse tilt (X)—of the support mattress (2), as shown in the previous figures, which provides the CPU with tilting measurements relative to these two axes, with the CPU preferably equipped with three memories—RAM for calculating variables, FLASH, which contains the firmware, and EEPRON, which contains the predetermined operating parameters and start-up conditions and also has two ports for I and J power drives that connect to K and L motors, respectively dedicated to producing longitudinal oscillations along the Y axis and transversal oscillations along the X axis; a dedicated input port (G) for the keyboard, an output port (H) for display data from the control panel (PC), plus, there may also be two analog ports, not shown, for inputting information on the currents instantaneously applied to (K) and (L) motors, and which switches them off in case of overload before they get hot.

Figure 7:
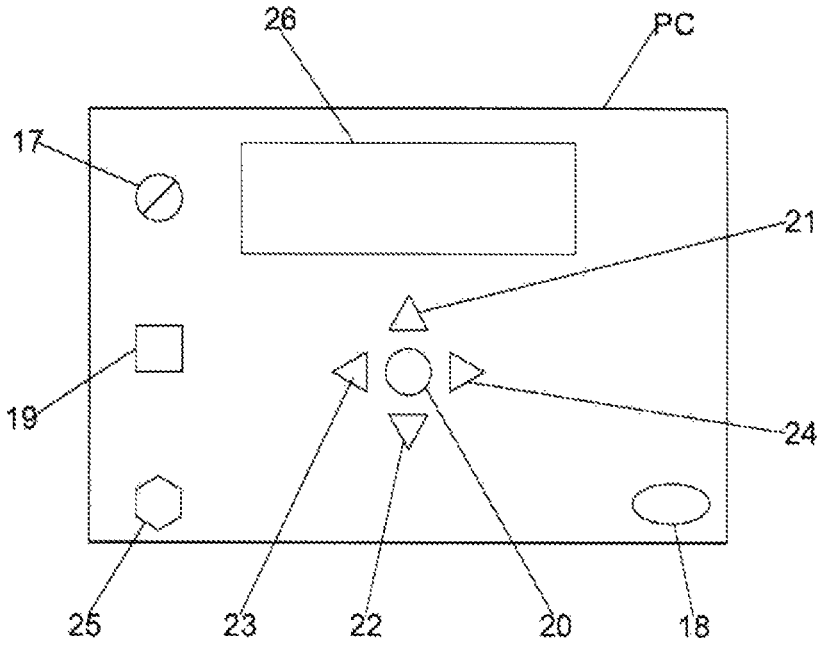
FIG. 7 is a schematic front view of the control panel.

FIG. 7 is a schematic front view of the control panel (CP), illustrating its embodiment, having been designed to be conventionally controlled so that the training of operators or users of this invention would be simple and easy, i.e., operated as a key cell phone consisting of one display (26), alphanumeric, backlit, with two lines of sixteen characters and eight keys, that allows the activation and control of various functions, such as:

The first touch key activates the "START" function (17)—the green LED lights up—and the second key activates the "STOP" function—the red LED lights up; a key to activate the "Return both tilts to the level position" (18); a key to activate "MENU" (19), where the display shows "TRANSVERSAL" and "LONGITUDINAL"; a set conventionally arranged with five keys, the main navigation key activating "ENTER" (20), which allows sub-menus to be accessed and changed, i.e., access and make changes in transversal and longitudinal directions, as per the MENU shown on the display (26), and when the "ENTER" key (20) is pressed the second time, the display (26) shows three digits, the last digit to the right being a decimal point, and by pressing the "ENTER" key" (20), the amplitude in centimeters and duration in minutes are set for either direction, as selected on the MENU, and display (26) digits "blink" to remind the user of the possibility of new programming by using the set of navigation keys placed at the four cardinal points around the "ENTER" key (20), the upper key being "UP" (21), the lower key being "DOWN" (22), the left key "LEFT" (23), and the right key "RIGHT" (24); the display (20) also has an alarm buzzer (25) that emits an overload sound signal and informs the user that the motors (K and L) have been switched off.

The invention claimed is:

1. Oscillating hospital bed for preventing decubitus ulcers comprising an arched mattress support, a longitudinally orientated cylindrical shaft connected to the mattress support and configured to allow the mattress support to oscillate transversely, a first vertical shaft having a worm thread, the first vertical shaft connected to the mattress support and configured to raise and lower to cause transverse oscillations, a vertically orientated cylindrical shaft connected to the mattress support and configured to allow the mattress support to oscillate vertically, a second vertical shaft having a worm thread, the second vertical shaft connected to the mattress support and configured to raise and lower the mattress support to cause vertical oscillations, two drive systems, one driving the first vertical shaft for transverse oscillations and the other driving the second vertical shaft for longitudinal oscillations wherein said each of the two drive systems are battery-operated without connection to an electric grid, said two drive systems operate by intermittent electrical pulses so as to increase battery life, wherein said two drive systems oscillate the mattress support for preventing decubitus ulcers.

* * * * *